US009470065B2

(12) United States Patent
Kruger et al.

(10) Patent No.: US 9,470,065 B2
(45) Date of Patent: Oct. 18, 2016

(54) EXPANDABLE BRUSH

(71) Applicant: Baker Hughes Incorporated, Houston, TX (US)

(72) Inventors: Samuel K. Kruger, New Iberia, LA (US); Joseph Cottrell, Lafayette, LA (US); George N. Kreig, Broussard, LA (US)

(73) Assignee: BAKER HUGHES INCORPORATED, Houston, TX (US)

( * ) Notice: Subject to any disclaimer, the term of this patent is extended or adjusted under 35 U.S.C. 154(b) by 182 days.

(21) Appl. No.: 14/474,520

(22) Filed: Sep. 2, 2014

(65) Prior Publication Data

US 2016/0061006 A1 Mar. 3, 2016

(51) Int. Cl.
*E21B 37/02* (2006.01)

(52) U.S. Cl.
CPC ..... *E21B 37/02* (2013.01)

(58) Field of Classification Search
CPC ..... E21B 37/02; E21B 37/04
See application file for complete search history.

(56) References Cited

U.S. PATENT DOCUMENTS

| | | | | |
|---|---|---|---|---|
| 5,012,866 | A | 5/1991 | Skipper | |
| 8,141,627 | B2 | 3/2012 | Krieg et al. | |
| 2003/0024702 | A1* | 2/2003 | Gray | E21B 29/005 166/301 |
| 2011/0240058 | A1* | 10/2011 | Jonassen | B08B 9/0436 134/8 |

FOREIGN PATENT DOCUMENTS

WO 01-66907 A1 9/2013

* cited by examiner

*Primary Examiner* — David Andrews
*Assistant Examiner* — Kristyn Hall
(74) *Attorney, Agent, or Firm* — Shawn Hunter

(57) ABSTRACT

Expandable brushes for cleaning a surrounding tubular member. Brushes include a housing to be disposed within the surrounding tubular member and a brush shoe that retains at least one brush bristle, the brush shoe being radially moveable with respect to the housing between a radially retracted position and a radially expanded position.

7 Claims, 7 Drawing Sheets

EXPANDABLE BRUSH

BACKGROUND OF THE INVENTION

1. Field of the Invention

The invention relates generally to brushes used for cleaning wellbores and subterranean tubular members.

2. Description of the Related Art

Brushes are used to clean and remove debris from wellbore casings, liners and other tubular members in a wellbore. A common occurrence requires these tools to pass through restrictions in the diameter of the tubular member being cleaned. Many conventional tools rely upon the flexibility of brush bristles to allow the brush to pass through such restrictions. In practice, unfortunately, damage often occurs easily to the bristles of downhole brush tools as they are passed through tubular restrictions.

SUMMARY OF THE INVENTION

The invention provides devices and methods for protecting the bristles of downhole brushes during operation. Downhole expandable brushes are described which include a housing that can be affixed to a running string and a brush assembly with at least a single set of brush bristles that extend outwardly through the housing and can be radially extended with respect to the housing to radially expand the brush. Additionally, the bristles of the brush may be radially retracted with respect to the housing so that the brush may be passed through restrictions in the surrounding tubular member without damaging the bristles. According to described embodiments, axial movement of a piston member with respect to the housing in a first axial direction causes the brush assembly to move radially outwardly while axial movement of the piston member with respect to the housing permits the brush assembly to retract radially with respect to the housing.

According to a first exemplary embodiment, the housing of the brush defines an interior axial flowbore through which fluid can be flowed. A piston member is retained within the flowbore and is axially moveable therein. Axial movement of the piston member with respect to the housing rotates one or more cams having eccentric profiles. The cam(s) will urge a brush assembly, having a shoe and bristles, radially outwardly. Reverse rotation of the cam(s) will permit the brush member to retract into the housing.

In a second described embodiment, a piston member is retained within the flowbore and is operably interconnected with a flexible linkage. Axial movement of the piston member with respect to the housing causes the linkage to flex and move a brush member radially outwardly. Reverse axial movement of the piston member will cause the linkage to unflex and move the brush member radially inwardly with respect to the housing.

According to a third embodiment, a brush member is mounted upon a shoe, which has an angled inwardly-directed ramp surface. A piston member is moveably disposed within a flowbore of the housing and presents an angled or conical surface which contacts the ramp surface of the shoe. Axial movement of the piston member moves the shoe and affixed bristles radially outwardly with respect to the brush housing.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
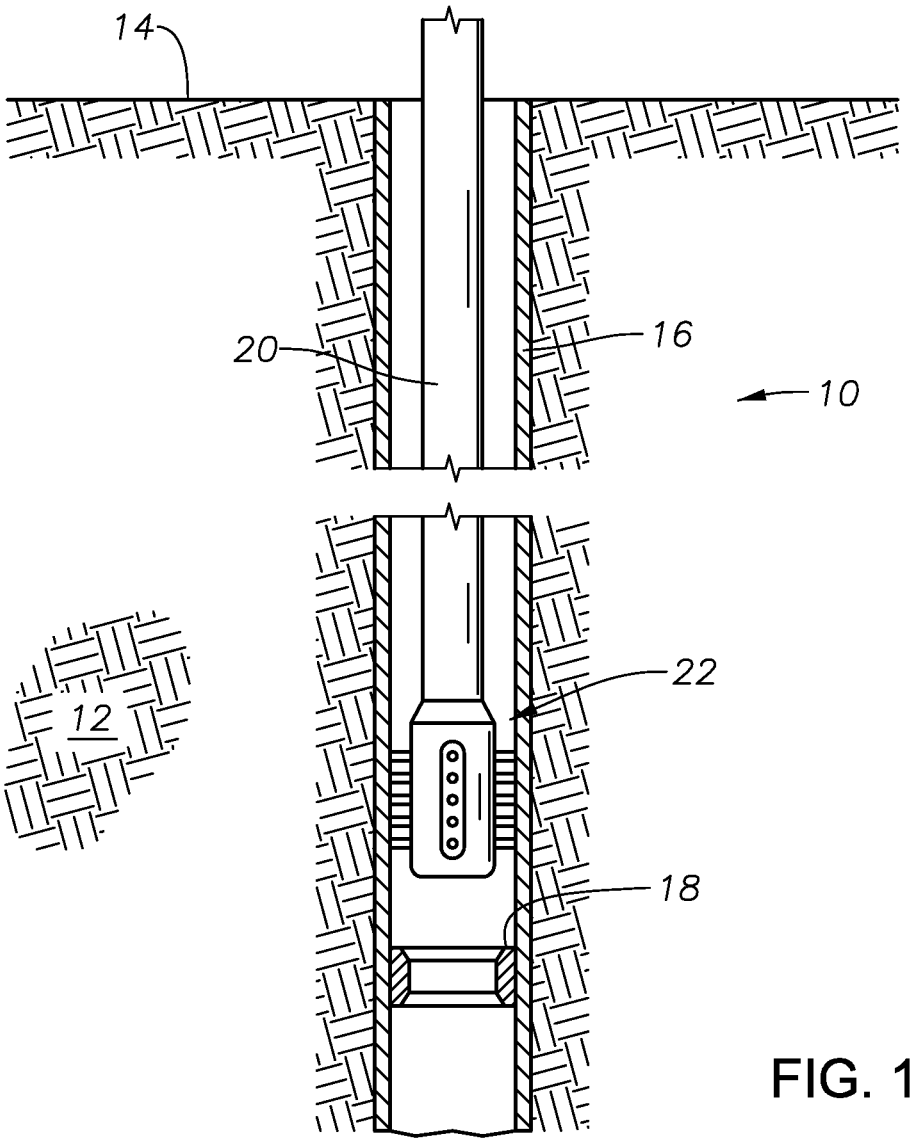
FIG. 1 is a side, cross-sectional view of an exemplary wellbore containing a running string with an affixed downhole brush tool in accordance with the present invention.

FIG. 1 illustrates an exemplary wellbore 10 that has been drilled through the earth 12 from the surface 14. The wellbore 10 is lined with metallic casing 16 of a type known in the art. The casing 16 presents a diametrical restriction 18. It is desired to clean or polish casing 16, particularly below the restriction 18.

A running string 20 is shown disposed into the wellbore 10 from the surface 14. The running string 20 may be coiled tubing or be made up of conventional drill string tubulars or have other constructions known in the art. An expandable brush 22 is shown affixed to the running string 20.

Figure 2:
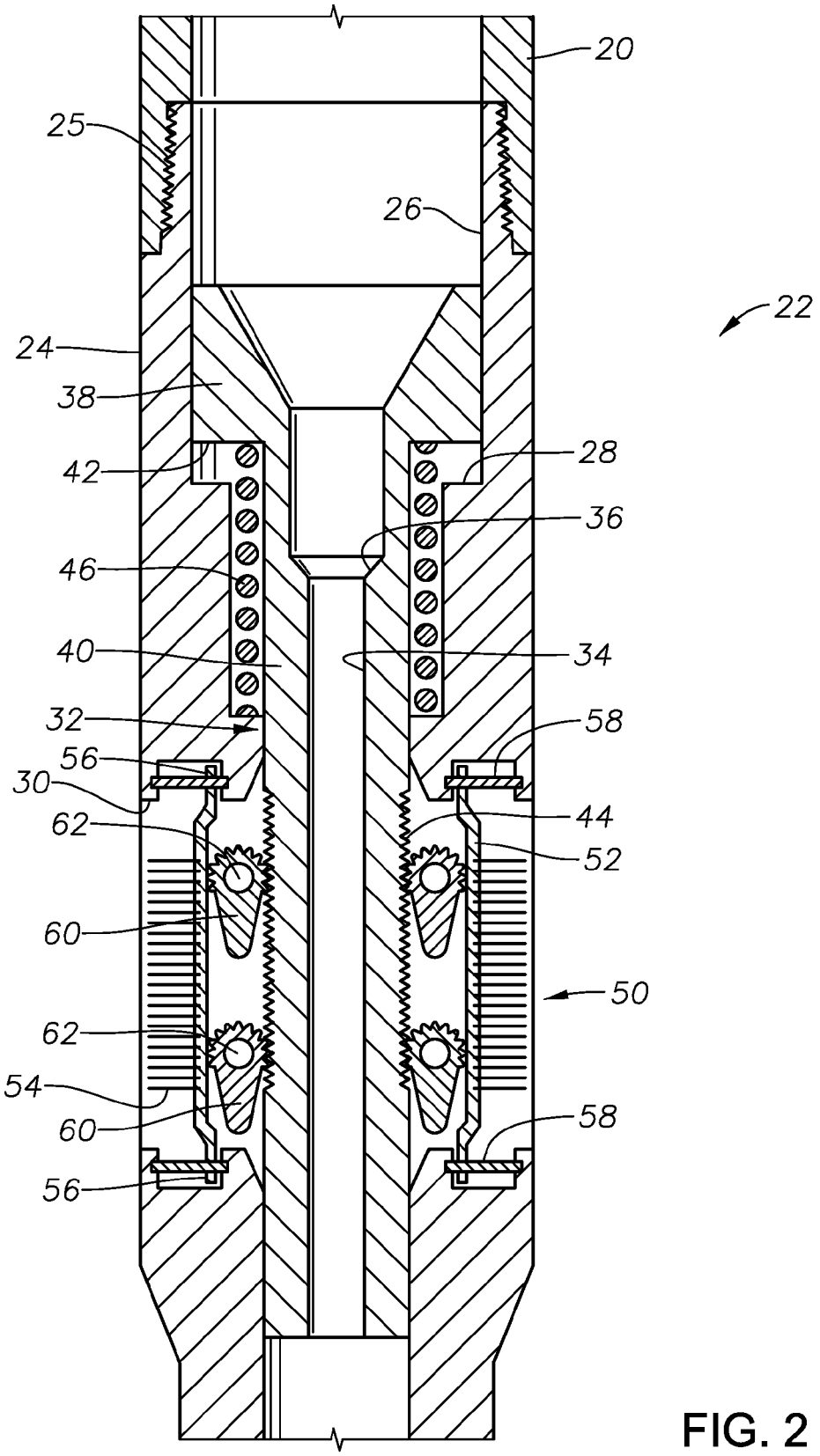
FIG. 2 is a side, cross-sectional view of an exemplary expandable brush in accordance with the present invention in a reduced diameter condition.
Figure 3:
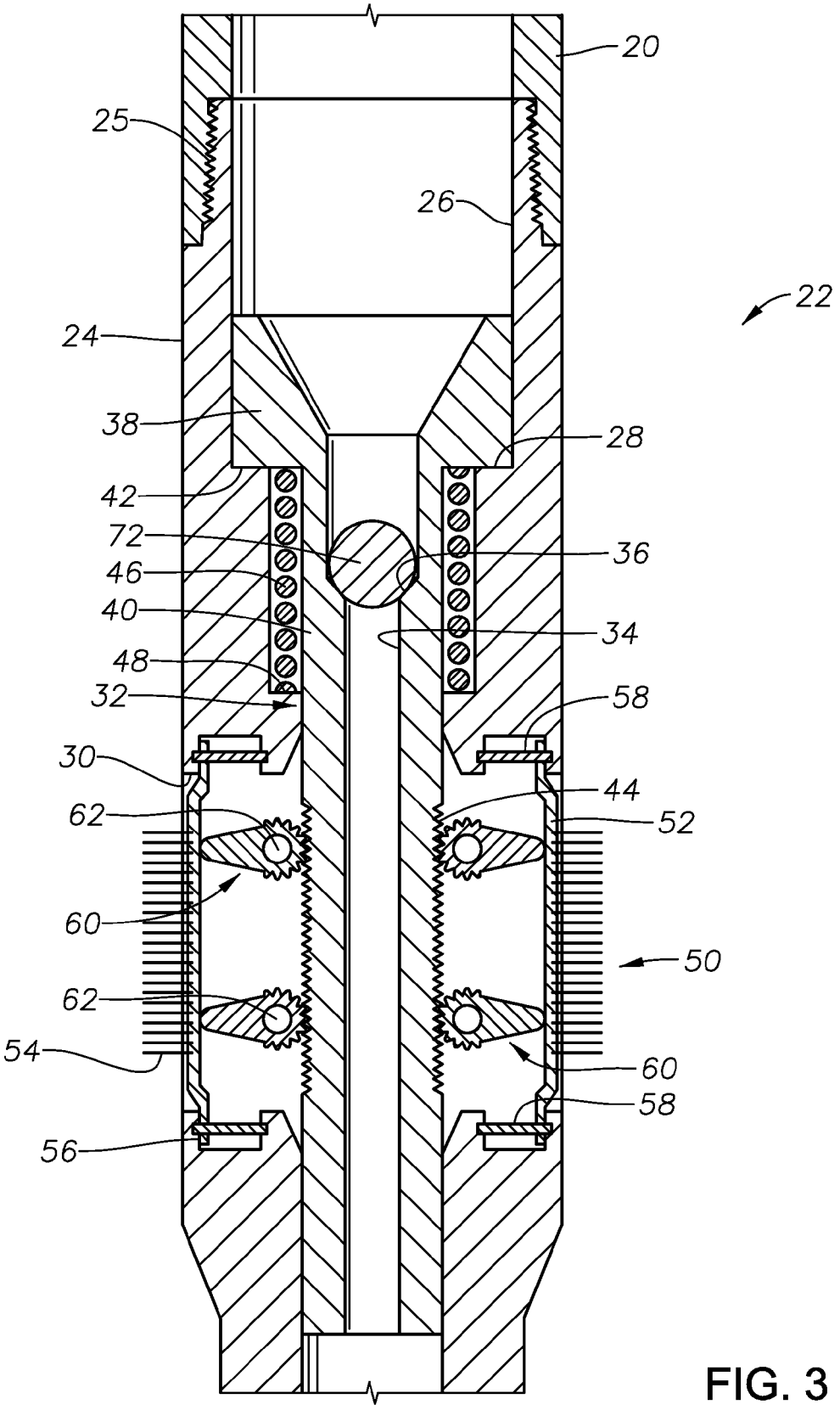
FIG. 3 is a side, cross-sectional view of the brush shown in FIG. 2, now in an expanded diameter condition.

A first exemplary expandable brush 22 is illustrated in FIGS. 2 and 3. The brush 22 includes a generally cylindrical outer housing 24 which is affixed to the running string 20 via threaded connection 25. The housing 24 is shaped and sized to fit within a surrounding tubular member which it is desired to clean, such as casing 16. The housing 24 has an axial fluid flowbore 26 defined along the length of the housing 24. An axially-facing stop shoulder 28 is formed within the flowbore 26. Lateral windows 30 are formed within the housing 24. In the depicted embodiment, there are two windows 30 shown. It should be understood, however, that this is for illustrative purposes only, and that there may be more or fewer than two windows 30 in practice. A piston member 32 is disposed within the flowbore 26. The piston member 32 includes an inner axial fluid passage 34 along its length. A ball or plug seat 36 is formed within the fluid passage 34. The piston member 32 presents an enlarged diameter section 38 and a reduced diameter section 40 which extends axially downwardly from the enlarged diameter section 38. A downward-facing shoulder 42 is presented on the outer radial surface of the piston member 32 between the enlarged diameter and reduced diameter sections 38, 40. The reduced diameter section 38 presents a radially outer toothed or notched profile 44.

A compression spring 46 is disposed radially between the outer housing 24 and the piston member 32. The compression spring 46 is located axially between the downward-facing shoulder 42 and an upward-facing shoulder 48 that is formed within the flowbore 26.

A brush assembly 50 is disposed within each of the windows 30. Each brush assembly 50 includes a brush shoe 52 that is shaped and sized to reside within its window 30 and be radially moveable inwardly and outwardly within the window 30. Bristles 54 are fixedly secured within each shoe 52 and extend radially outwardly therefrom. In a currently preferred embodiment, each shoe 52 has perforated end portions 56 which are slidably mounted upon rods 58 that are embedded within the outer housing 24. This permits the shoes 52 to move radially inwardly and outwardly through the windows 30.

Figure 4:
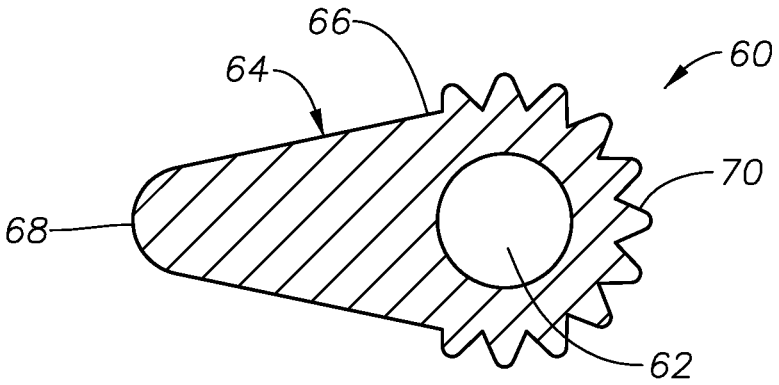
FIG. 4 is a detail view of a cam member used within the brush shown in FIGS. 1-2.

Rotatable cams 60 are also located within each of the windows 30 which are used to cause the brush assemblies 50 to be moved radially outwardly through the windows 30 when desired or withdrawn radially within the windows 30 when desired. In the depicted embodiment, there are two cams 60 shown located within each of the windows 30. However, it should be understood that there may be more or fewer than two such cams 60 for each window 30 or for each shoe 52, as desired. Each of the cams 60 rotate about a central pivot 62. As best seen in FIG. 4, each cam 60 features an eccentric outer profile 64 having a radially reduced profile portion 66 and an extended radius profile portion 68. The outer profile 64 of each cam 60 also features a toothed or notched portion 70 having teeth or notches that are shaped and sized to interfit with the teeth or notches of the toothed or notched profile 44 of the piston member 32 in a complementary manner.

The expandable brush 22 may be moved between a radially reduced configuration and a radially expanded configuration. In the radially reduced configuration (FIG. 2), the shoes 52 and bristles 54 are radially withdrawn within the outer housing 24, thereby permitting the brush 22 to be passed through wellbore restrictions, such as diametrical restriction 18 in FIG. 1. In the radially expanded configuration, the shoes 52 and bristles 54 are extended radially outwardly through their respective windows 30 in the housing 24 (see FIG. 3).

In order to cause the brush assemblies 50 of the brush 22 to be moved radially outwardly to the position shown in FIG. 3, a ball 72 is dropped into the running string 20 and enters the flowbore 26 of the brush 22. The ball 72 lands on the ball seat 36 of the piston member 32 and blocks fluid flow downwardly through the fluid passage 34. Thereafter, the running string 20 can be pressurized to cause the piston member 32 to move axially downwardly within the flowbore 26 until the downward-facing shoulder 42 of the piston member 32 is brought into abutting contact with the stop shoulder 28 of the outer housing 24. Compression spring 46 is compressed.

As the piston member 32 is moved axially downwardly within the housing 24, the toothed or notched interface between profile 44 and the toothed or notched portion 70 of the cams 60 cause the cams 60 to be rotated about their pivots 62. The cams 60 are rotated from a position wherein the reduced profile portion 66 is adjacent the shoe 52 of the brush assembly 50 (see FIG. 2) to a position wherein the extended radius profile portion 68 is adjacent the shoe 52 (see FIG. 3), thereby moving the brush assembly 50 radially outwardly through its window 30.

In order to return the brush 22 to its reduced diameter configuration, fluid pressurization within the running string 20 is stopped. The compression spring 46 will urge the piston member 32 axially upwardly within the flowbore 26 of the outer housing 24. As the piston member 32 is moved axially upwardly the cams 60 are rotated in a reverse direction back to their original positions, thereby permitting the brush assemblies 50 to be moved radially inwardly to the positions illustrated in FIG. 2.

Figure 5:
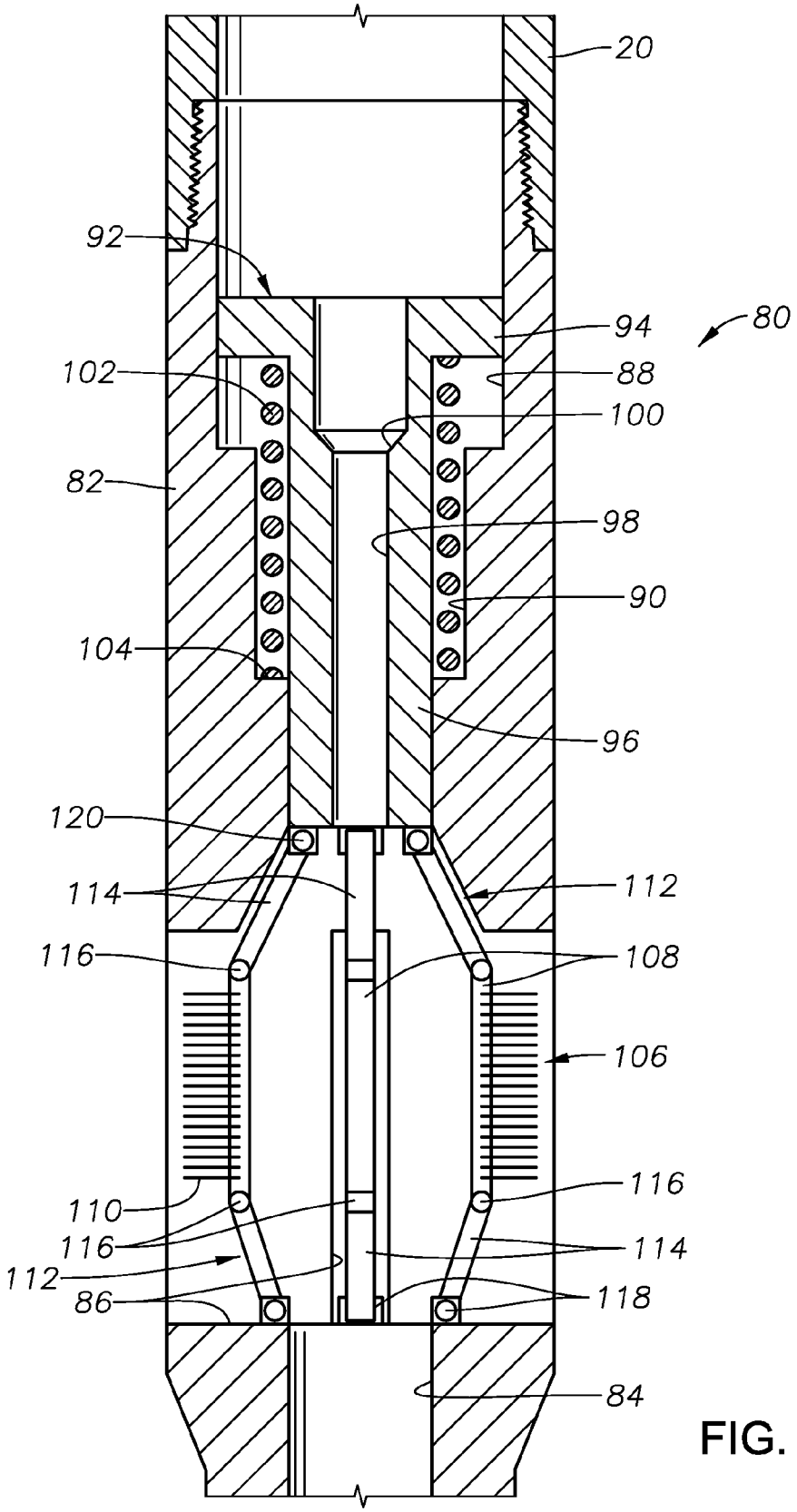
FIG. 5 is a side, cross-sectional view of an exemplary alternative embodiment for an expandable brush in accordance with the present invention in a reduced diameter configuration.
Figure 6:
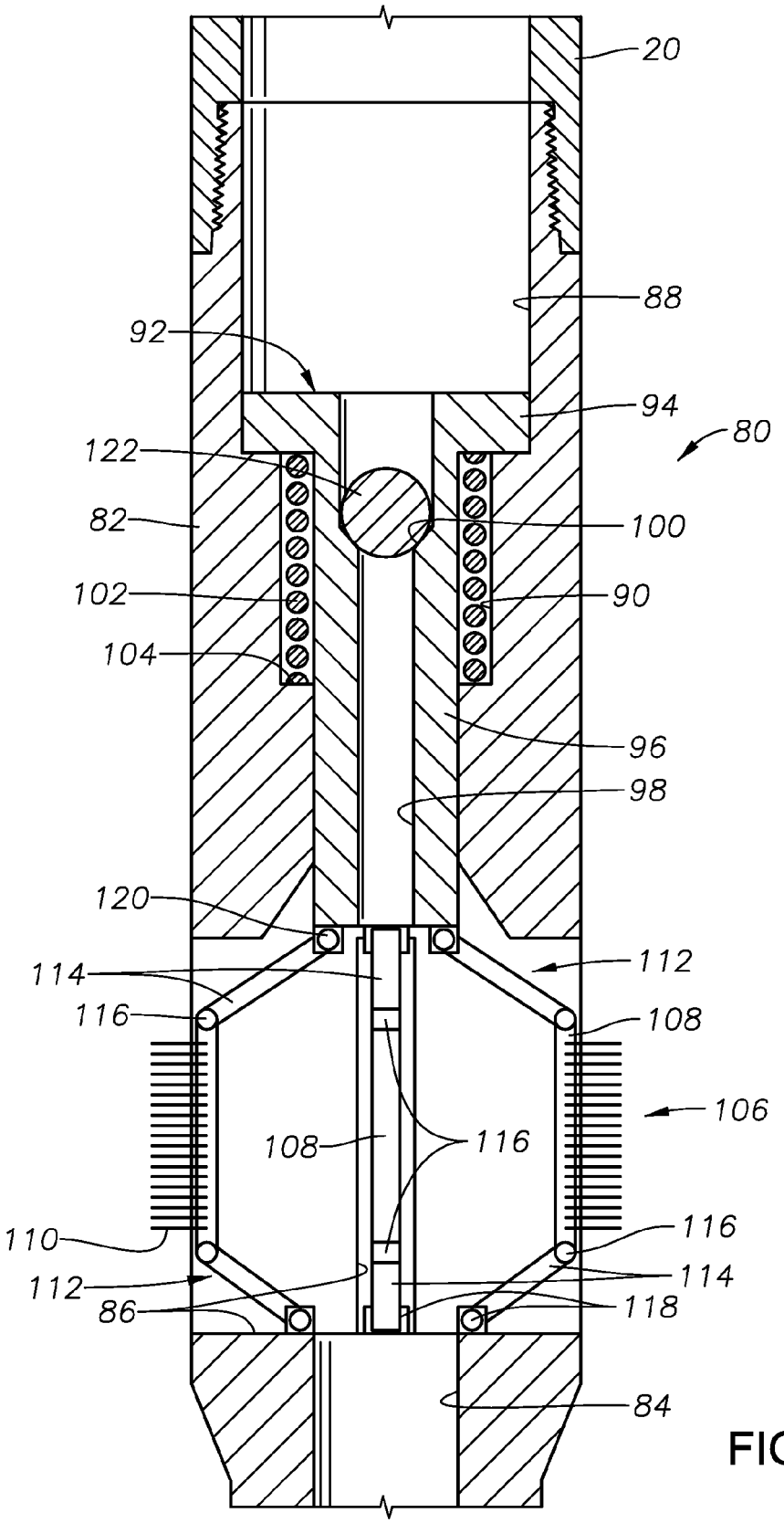
FIG. 6 is a side, cross-sectional view of the brush shown in FIG. 5, now in a radially expanded condition.

FIGS. 5 and 6 illustrate an alternative expandable brush 80. The brush 80 includes an outer housing 82 with axial flowbore 84 defined along its length. Lateral windows 86 are formed within the housing 82. A radially enlarged piston chamber 88 and spring chamber 90 are formed within the flowbore 84. A piston member 92 resides within the piston chamber 88 and spring chamber 90 and is axially moveable therewithin. The piston member 92 includes a radially enlarged upper portion 94 and a radially reduced lower portion 96. An axial fluid passage 98 is formed within the piston member 92. Ball seat 100 is formed within the fluid passage 98.

A compression spring 102 resides within the spring chamber 90 to radially surround the lower portion of the piston member 92. The spring 102 is bounded at the upper end by the enlarged diameter upper portion 94 of the piston member 92 and at its lower end by a shoulder 104 formed in the housing 82 at the lower end of the spring chamber 90. Thus, the compression spring 102 urges the piston member 92 upwardly with respect to the housing 82.

Brush assemblies 106 are movably disposed within each window 86. In the depicted embodiment, there are four windows 86 (three visible) formed within the housing 82 and a brush assembly 106 is associated with each window 86. However, it should be understood that there may be more or fewer than four windows 86 and brush assemblies 106. Each of the brush assemblies 106 features a brush shoe 108 with bristles 110 extending radially outwardly therefrom. Each of the brush assemblies 106 also includes a flex linkage 112 that is made up of articulated arms 114 and pivot points 116 which join lower arms 114 to the shoe 108. In the depicted embodiment, there are two arms 114 which support each shoe 108. Pivot points 118 join the arms 114 to the housing 82. Pivot points 120 is affixed to the piston member 92. Thus, downward movement of the piston member 92 will cause the arms 114 to move about their pivot points 116, 118 and 120 so that the shoe 108 and bristles 110 are moved radially outwardly through their respective window 86 (FIG. 6).

In order to move the brush 80 from the radially retracted position (FIG. 5) to the radially expanded position (FIG. 6), a ball 122 is dropped into the running string 20 from surface 14. The ball 122 lands on the ball seat 100, and the running string 20 is pressured up behind the ball 122 urging the piston member 92 axially downwardly within the housing 82 and compressing spring 102. The flex linkage 112 is articulated so that the shoe 108 and bristles 110 are moved radially outwardly. To return the brush 80 to the radially reduced configuration, the running string 20 is unpressurized, allowing the compression spring 102 to urge the piston member 96 axially upwardly and returning the brush 80 to the reduced diameter configuration shown in FIG. 5.

Figure 7:
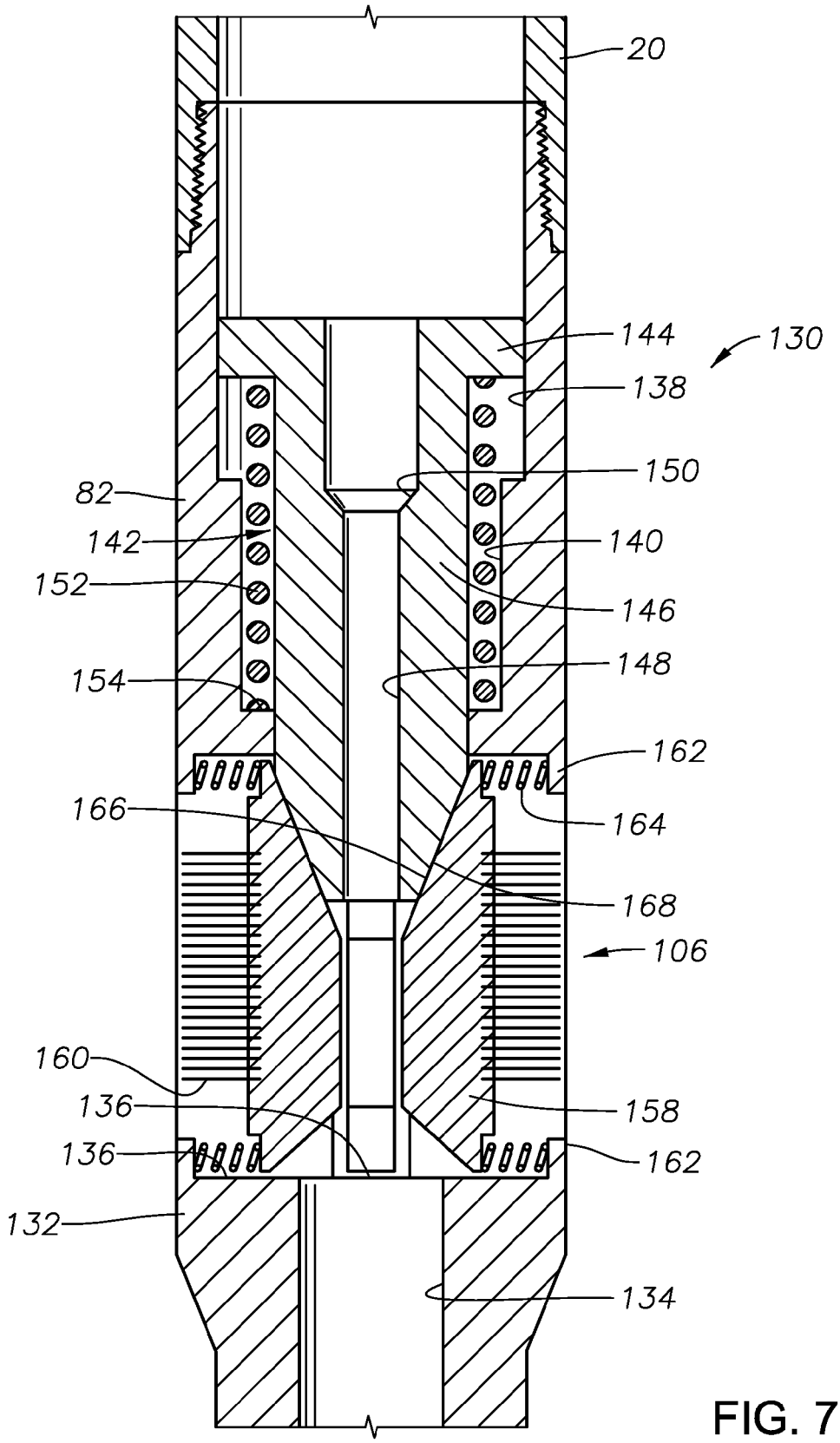
FIG. 7 is a side, cross-sectional view of another exemplary alternative embodiment for an expandable brush in accordance with the present invention in a reduced diameter configuration.
Figure 8:
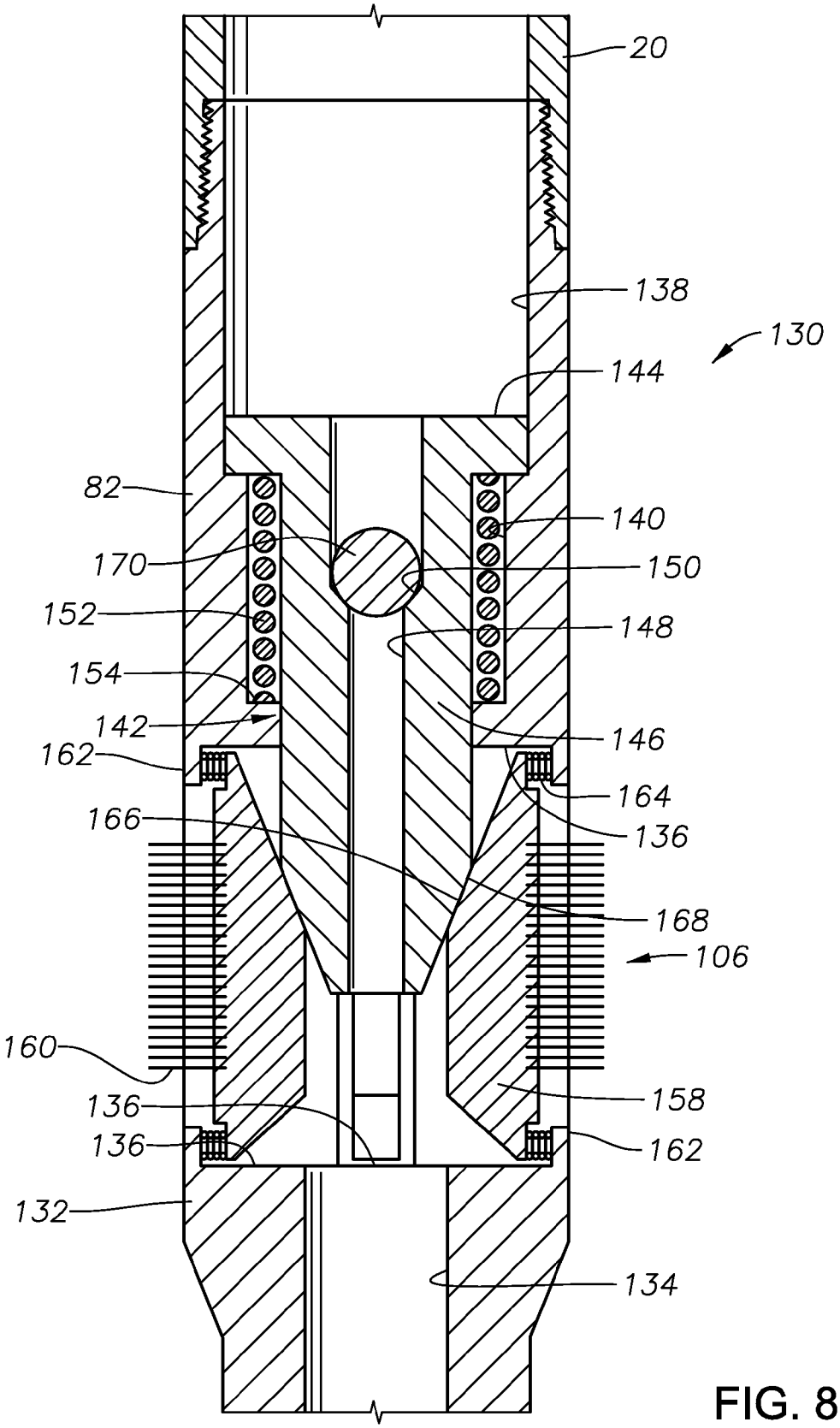
FIG. 8 is a side, cross-sectional view of the brush shown in FIG. 7, now in a radially expanded condition.

FIGS. 7 and 8 depict a further alternative expandable brush 130. The brush 130 includes a housing 132 having axial flowbore 134 defined along its length. Lateral windows 136 are formed within the housing 132. A radially enlarged piston chamber 138 and spring chamber 140 are formed within the flowbore 134. A piston member 142 resides within the piston chamber 138 and spring chamber 140 and is axially moveable therewithin. The piston member 142 includes a radially enlarged upper portion 144 and a radially reduced lower portion 146. An axial fluid passage 148 is formed within the piston member 142. Ball seat 150 is formed within the fluid passage 148.

A compression spring 152 resides within the spring chamber 140 to radially surround the lower portion 146 of the piston member 142. The spring 152 is bounded at the upper end by the enlarged diameter upper portion 144 of the piston member 142 and at its lower end by a shoulder 154 formed in the housing 132 at the lower end of the spring chamber 140. Thus, the compression spring 152 urges the piston member 142 upwardly with respect to the housing 132.

Brush assemblies 156 are movably disposed within each window 136. In the depicted embodiment, there are four windows 136 (three visible) formed within the housing 132 and a brush assembly 156 is associated with each window 136. However, it should be understood that there may be more or fewer than four windows 136 and brush assemblies 156. Each of the brush assemblies 156 features a brush shoe 158 with bristles 160 extending radially outwardly therefrom. Each brush shoe 158 is shaped and sized to be moveable radially inwardly and outwardly through its respective window 136. Preferably, a retainer lip 162 is formed at the periphery of each window 136 to prevent the brush shoe 158 from being lost outside of the housing 132. Compression spring 164 biases the brush shoe 158 radially inwardly.

Each brush shoe 158 presents a radially-inward facing angled ramp face 166. The lower portion 146 of the piston member 142 presents an angled or conical surface 168 that contacts the ramp faces 166 of the brush shoes 158. Due to the interface of the angled surface 168 and ramp faces 166, downward axial movement of the piston member 142 within the housing 132 will move the brush shoes 158 and bristles 160 radially outwardly with respect to the housing 132.

In order to move the brush 130 from the radially retracted position (FIG. 7) to the radially expanded position (FIG. 8), a ball 170 is dropped into the running string 20 from surface 14. The ball 170 lands on the ball seat 150, and the running string 20 is pressured up behind the ball 170 urging the piston member 142 axially downwardly within the housing 132 and compressing spring 152. The brush shoes 158 and bristles 160 are moved radially outwardly. To return the brush 130 to the radially reduced configuration, the running string 20 is unpressurized, allowing the compression spring 152 to urge the piston member 142 axially upwardly and returning the brush 130 to the reduced diameter configuration shown in FIG. 7.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. An expandable brush for cleaning a surrounding tubular member, the brush comprising:

a housing to be disposed within the surrounding tubular member;

an axial flowbore formed within the housing;

a piston member disposed within and axially moveable within the flowbore;

a brush shoe that retains at least one brush bristle, the brush shoe being radially moveable with respect to the housing between a radially retracted position and a radially expanded position;

a rotatable cam member operably associated with the brush shoe and the piston member so that axial movement of the piston member will rotate the cam member to cause the brush shoe to be moved radially with respect to the housing;

the rotatable cam member presenting a notched portion that interfits with a notched profile of the piston member;

the rotatable cam member further presenting an eccentric outer profile having a radially reduced profile portion and an extended radius profile portion and wherein axial movement of the piston member in a first axial direction moves the brush shoe radially outwardly by rotating the rotatable cam member from a position wherein the reduced profile portion is adjacent the brush shoe to a position wherein the extended radius profile portion is adjacent the brush shoe; and wherein axial movement of the piston member in a first axial direction moves the brush shoe radially outwardly and axial movement of the piston member in a second axial direction allows the brush shoe to move radially inwardly.

2. The expandable brush of claim 1 further comprising:

a window formed within the housing; and the brush shoe is radially movable through the window.

3. An expandable brush for cleaning a surrounding tubular member, the brush comprising:

a housing to be disposed within the surrounding tubular member;

a piston member disposed within and axially moveable within the housing;

a brush shoe that retains at least one brush bristle, the brush shoe being radially moveable with respect to the housing between a radially retracted position and a radially expanded position;

a rotatable cam member operably associated with the brush shoe and the piston member so that axial movement of the piston member in a first axial direction moves the brush shoe radially outwardly and axial movement of the piston member in a second axial direction allows the brush shoe to move radially inwardly, the rotatable cam member presenting a notched portion that interfits with a notched profile of the piston member;

the rotatable cam member further presenting an eccentric outer profile having a radially reduced profile portion and an extended radius profile portion and wherein axial movement of the piston member in a first axial direction moves the brush shoe radially outwardly by rotating the rotatable cam member from a position wherein the reduced profile portion is adjacent the brush shoe to a position wherein the extended radius profile portion is adjacent the brush shoe.

4. The expandable brush of claim 3 wherein the piston member disposed within and axially moveable within a flowbore within the housing.

5. The expandable brush of claim 3 further comprising:

a window formed within the housing; and the brush shoe is radially movable through the window.

6. An expandable brush for cleaning a surrounding tubular member, the brush comprising:

a housing to be disposed within the surrounding tubular member;

a brush shoe that retains at least one brush bristle, the brush shoe being radially moveable with respect to the housing between a radially retracted position and a radially expanded position;

an axial flowbore formed within the housing;

a piston member disposed within and axially moveable within the flowbore;

a rotatable cam member operably associated with the brush shoe and the piston member so that axial movement of the piston member rotates the cam member to move the brush shoe to its radially expanded position, the rotatable cam member presenting a notched portion that interfits with a notched profile of the piston member; and the rotatable cam member further presenting an eccentric outer profile having a radially reduced profile portion and an extended radius profile portion and wherein axial movement of the piston member in a first axial direction moves the brush shoe radially outwardly by rotating the rotatable cam member from a position wherein the reduced profile portion is adjacent the brush shoe to a position wherein the extended radius profile portion is adjacent the brush shoe.

7. The expandable brush of claim 6 further comprising:

a window formed within the housing; and the brush shoe is radially movable through the window.

* * * * *